United States Patent [19]

Valentino

[11] Patent Number: 4,602,786

[45] Date of Patent: Jul. 29, 1986

[54] BASEBALL IN MINIATURE

[76] Inventor: John J. Valentino, 362 Herricks Rd., Mineola, N.Y. 11501

[21] Appl. No.: 753,863

[22] Filed: Jul. 11, 1985

[51] Int. Cl.[4] ..... A63F 7/20

[52] U.S. Cl. ..... 273/89; 273/90

[58] Field of Search ..... 273/90, 89; 124/7

[56] References Cited

U.S. PATENT DOCUMENTS

| | | | |
|---|---|---|---|
| 983,250 | 1/1911 | Porter | 273/89 |
| 1,008,898 | 11/1911 | Fulton et al. | 273/89 |
| 1,048,047 | 12/1912 | Curtis | 273/89 |
| 1,464,314 | 8/1923 | Gates | 273/89 |
| 1,551,216 | 8/1925 | Potter | 273/89 |
| 1,620,866 | 3/1927 | Booth | 273/89 |
| 1,772,116 | 8/1930 | Snodgrass | 273/89 |
| 2,362,188 | 11/1944 | Clark | 273/89 |
| 2,462,170 | 2/1949 | Dube | 273/90 |
| 2,672,343 | 3/1954 | Augier | 273/90 |
| 2,802,667 | 8/1957 | Bertley | 273/89 |
| 3,355,173 | 11/1967 | Selker | 273/89 |
| 3,534,962 | 10/1970 | Singleman | 273/90 |
| 3,605,715 | 9/1971 | Welbourn | 124/7 |
| 4,017,074 | 4/1977 | Roberts | 273/89 |
| 4,111,179 | 9/1978 | Hashimoto | 124/7 |
| 4,179,123 | 12/1979 | Tsukuda | 273/89 |

*Primary Examiner*—Paul E. Shapiro

*Attorney, Agent, or Firm*—Bucknam and Archer

[57] ABSTRACT

A miniature baseball game played on a board, having a miniature baseball, a pitching device, miniature, swingable bats and a restraining device to limit the swing of the player at bat so as to be compatible with the scaled down size of the game.

7 Claims, 16 Drawing Figures

BASEBALL IN MINIATURE

BACKGROUND OF THE INVENTION

This invention relates to a board type game, specifically to a device enabling two or more players to play a simulated game of baseball in which the player can exercise skill in batting, pitching and strategic thinking based on a thorough knowledge of the rules of the game.

Many devices have been designed for playing simulated baseball games. Most of them employ a board with a scaled down reproduction of a baseball field. In some, the reproduction is authentic as regards placement of bases, home plate, pitcher's box and fielders. However, in many prior art games this is not so, because the pitching device is not properly located. The ball is usually a plastic or metal ball or a disc which generally rolls or slides on the playing surface. Thus most of these games have been played in only two dimensions. Means are provided to pitch and bat the ball, most of them being mechanized contrivances or linkages which do not give the players opportunity to exercise skill in hitting or pitching the ball. For these and other reasons, none of these games have enjoyed wide acceptance.

An example of a prior art game is found in U.S. Pat. No. 2,775,457 issued to Galbos. In it, the reproduction of the baseball diamond on the playing board is authentic. However, the pitching device consists of inclined grooves, the "bat" rotates about pivots fixed in the board and is twirled rather than swung, and the miniature baseball rolls on the board.

Another example is U.S. Pat. No. 4,017,074 issued to Roberts. In this game the reproduction of the baseball diamond on the board is not authentic. The pitching device, which is essentially a form of slingshot, is located at the corner of the playing board furthest from home plate, beyond the outfield area. The "bat" is actually a spring-driven paddle which swings about an axis perpendicular to the board. The "ball" is a metal disc which slides on the playing surface.

Other examples are U.S. Pat. Nos. 3,227,452 issued to Murphy, 3,830,497 issued to Peterson, 3,879,037 issued to Cooke and 2,829,895 issued to Moen.

Accordingly, it is an object of this invention to provide a miniature baseball game which can be played in a manner similar to an actual baseball game.

It is another object of this game to provide a means for batting the pitched ball in midair, and which can be used with variable effect, depending on the skill of the player.

An additonal object of this invention is to provide a miniature baseball game which can be played according to the standard rules governing actual baseball games, employing strategies and tactics used in actual baseball games.

SUMMARY OF THE INVENTION

I have invented a miniature baseball game comprising, in combination, a horizontal board approximately four feet square on which is reproduced a baseball diamond, two boards perpendicular to the playing board and approximately $3\frac{1}{2}$ inches high to serve as outfield walls and removable strips which act as bunt lines. Three movable discs serve as the outfielders and four movable blocks represent the infielders, means being supplied to hold the infield blocks in place.

A pitching mechanism, correctly located in the infield, comprises the means for pitching the bass, which is solid and approximately $1\frac{1}{8}$ to $1\frac{1}{4}$ inches in diameter, through the air towards the batter.

Any one of three minature bats, between $4\frac{1}{2}$ and 6 inches in length and between $\frac{5}{8}$ and $\frac{3}{4}$ inches in diameter, can be used by the players to hit the ball. Right and left adjustable batter's grooves are mounted on the board and are provided with means to restrict the swing of the player at bat to a maximum compatible with the scaled-down dimensions of the game.

Markings and spots are placed in the infield, for designation of Normal Throw and Pitch Out Throw; metal strike zone plates are used to indicate called strikes. A throwing device enables players to throw the ball in play.

Other objects and advantages of the present invention will become apparent from the description of the drawings and the preferred embodiment which follows.

DESCRIPTION OF THE PREFERRED EMBODIMENT

Figure 1:
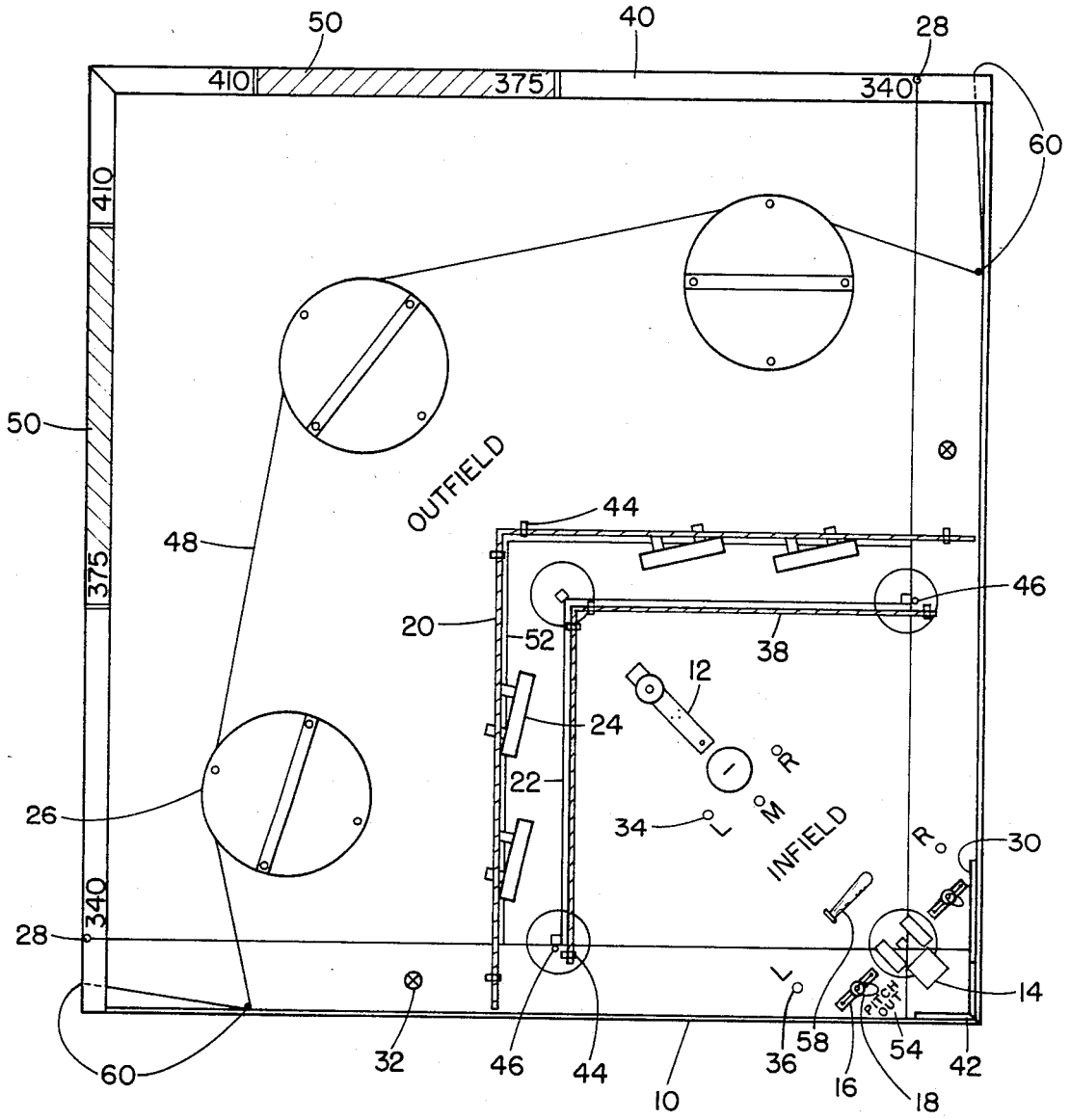
FIG. 1 of the drawings is a plan view of the miniature baseball game according to my invention.

Referring to FIG. 1 of the drawings, the game is played on a flat baseboard 10 approximately 4 feet by 4 feet. The baseboard can be made to fold in half for easy storage and it can be painted or covered with a felt like material. A baseball diamond is imprinted on the baseboard. The outfield walls 40 are simulated by two boards, running the full length of the baseboard, approximately $3\frac{1}{2}''$ in height. A simulated back stop wall 42 approximately 4" high is fastened to the baseboard at the corner adjacent to home plate. A pitching mechanism 12 is fastened to the board. Three movable discs 26, approximately 12" in diameter, are positioned in the outfield. Each of the discs is provided with an eyelet through which is passed a cord 48, representing the extra base marker. The cord 48, is fastened to the edges of the baseboard 10, by means of slots 60, permitting the extra base marker 48 to be moved. The infield positions are simulated by means of four infield blocks 24, each approximately $2\frac{1}{2}''$ in height, 4" long and 1" wide. These blocks can be weighted or they can be fitted with brackets to keep them in place. A removable infield back line barrier 20, is simulated by two strips of wood or plastic which run the length of the rear infield line past the foul line and to the side wall. Two removable strips of wood or plastic 38, running the length of the base paths, serve as bunt barriers. The lines 22 represent the infield front line, and lines 52 the infield back line. Numeral 30 is a removable wall placed opposite the batter designated to keep the ball in the playing area as much as possible. Numeral 32 designates the place where the strategy cards are placed.

The bat 58, shown resting on the playing board, comes in three sizes. It consists of a minature bat which can be $\frac{5}{8}$ to $\frac{3}{4}''$ in diameter and $4\frac{1}{2}''$ to $6''$ long. Right and left adjustable batter's restraints 16, are affixed to the board 10, on each side of home plate. A movable metal strike zone plate 14 is placed on the playing surface behind home plate. Two movable metal pitch-out plates 54 are placed on the playing surface, one on each side of the strike zone plate 14. Two dowels 46, inserted in holes drilled in the baseboard serve as foul indicators. In addition, two longer dowels 28, are positioned at the ends of the outfiled walls 40, to serve as foul poles.

Figure 2C:
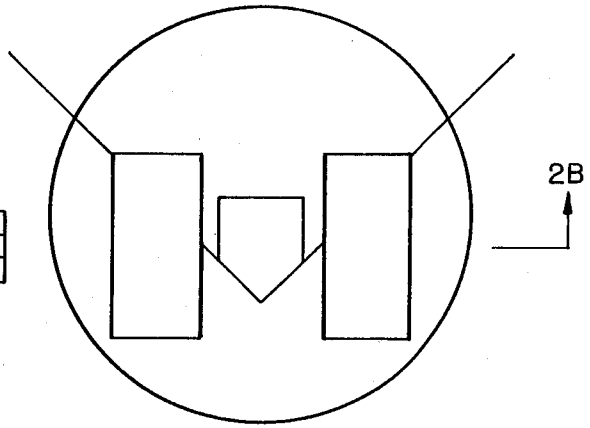
FIG. 2C is the home plate.
Figure 2A:
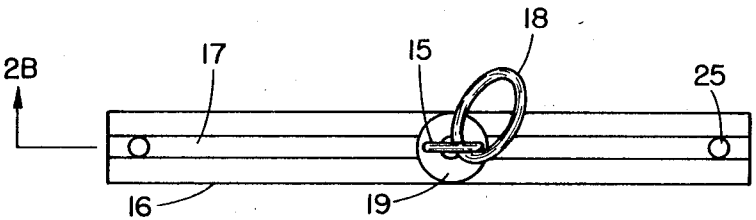
FIG. 2A of the drawings shows a plan view and FIG. 2B is a cross sectional view, on an enlarged scale, of a portion of the board of FIG. 1 illustrating the batter restraining means.
Figure 2B:
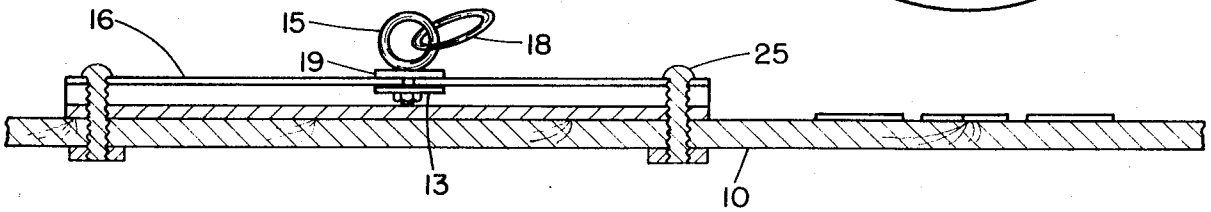

The adjustable batter's restraint 16 is shown in detail in FIG. 2. It consists of an elongated form, that can be made of metal or plastic, with a groove 17 running along its length. Eyelet 15 and washer 19 slide in this groove. The eyelet 15 is retained in the groove by means of the second washer 13. A flexible finger loop 18, is attached to the eyelet 15. Numeral 25 designates a bolt to secure the groove to the board. In order to play the game, the player inserts the pinky of his hand into the finger loop 18 and holds the bat 58. Thus, his swing is restricted because his pinky is held in the finger loop 18. However, within the limitations imposed by this restraint, the player can hit the ball with varying force and in various directions. Thus his skill and judgement can be exercised when he is up at bat.

By making the loop 18 larger, the restraining device may be used to restrain the wrist.

Figure 3C:
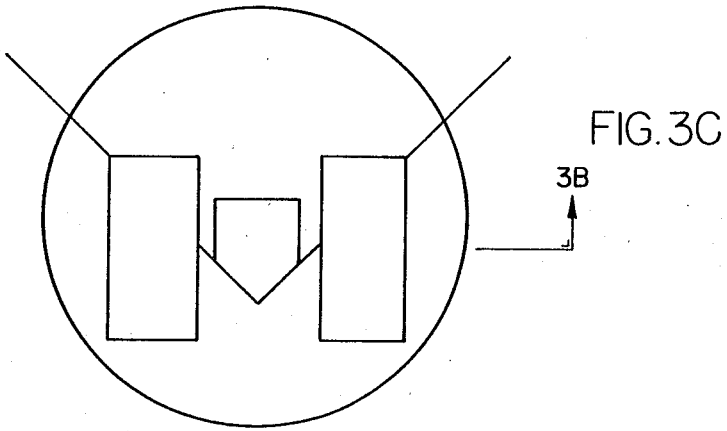
FIG. 3C is the home plate.
Figure 3A:
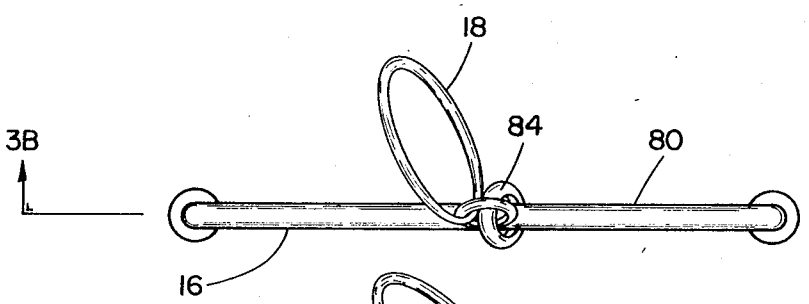
FIG. 3A of the drawings is a plan view and FIG. 3B is a cross sectional view of alternate embodiment of the portion of the board shown in FIG. 2.
Figure 3B:
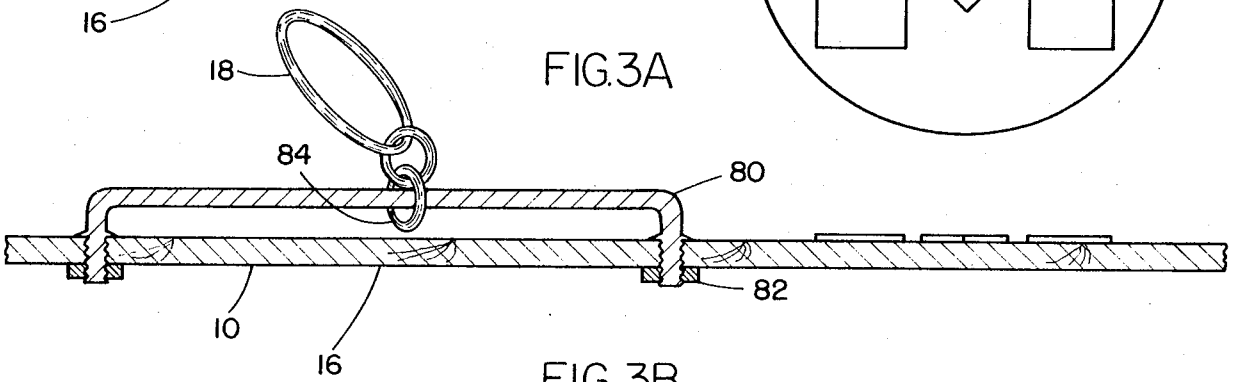

FIGS. 3A and 3B show an alternate embodiment of the batter's restraint 16. In the embodiment of FIGS. 3A and 3B, numeral 80 is an elongated rod fastened to the base board at both ends by means of a retaining nut 82. Numeral 18 designates the same flexible ring-shaped loop as in FIG. 2 slidably attached to the rod by a double ring 84.

Figure 4A:
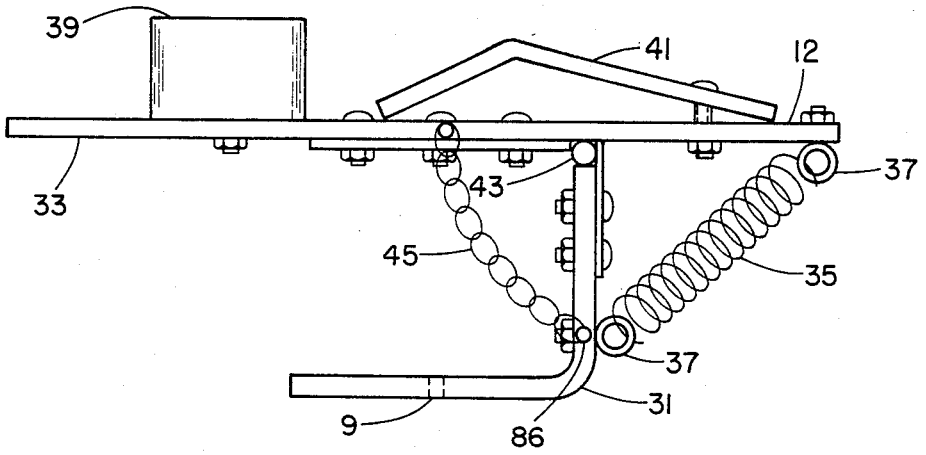
FIGS. 4A and 4B of the drawings show a plan and side elevational view respectively of a pitching mechanism for use in the invention.
Figure 4B:
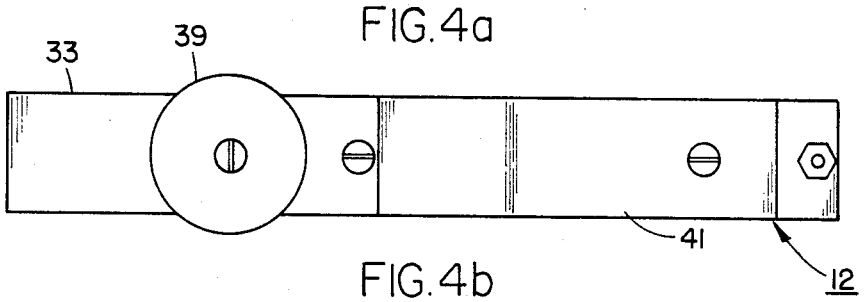
Figure 5A:
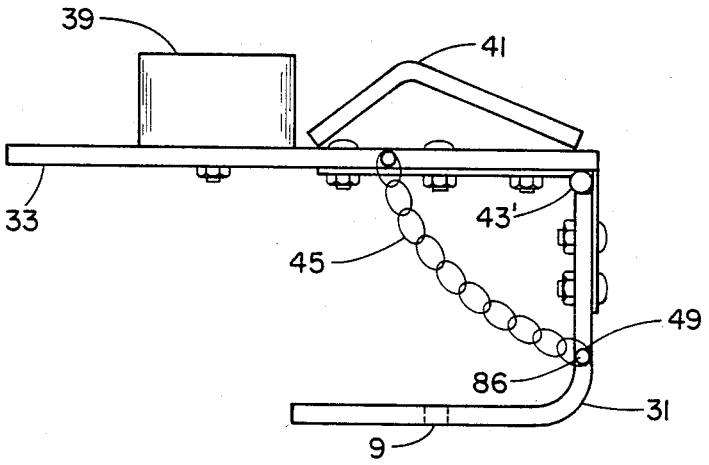
FIGS. 5A and 5B are a plan and side elevation respectively of an alternate embodiment of the pitching mechanism for use in the miniature baseball game.
Figure 5B:
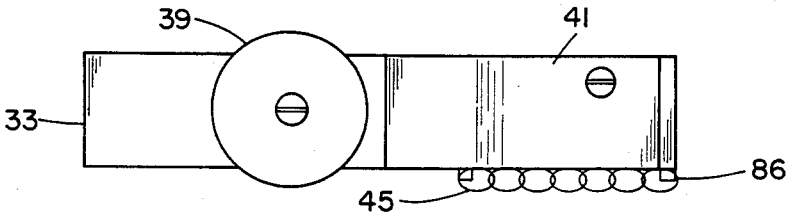

The pitching mechanism 12 is illustrated in FIG. 4. It consists of an angle bracket 31 fastened to the baseboard 10 by means of a screw or rivet through the hole 9. A crosspiece 33, is attached to the angle bracket 31 by means of a hinge 43. One end of a spring 35 is attached to an eyelet 37 fastened to the crosspiece 33, and the other end of spring 35 is fastened to an eyelet 37 attached to the angle bracket 31. A receptacle 39 with a concave surface for holding the ball, is attached to the crosspiece 33. A ball deflector 41 is attached to crosspiece 33 in front of the receptacle 39. An adjustable stop 45 is also attached to the angle bracket 31. This adjustable stop consists of a chain with loops connectable to a hook 86 near the bottom of the angle bracket 31. In order to pitch, the ball is placed in receptacle 39 and the end of crosspiece 33 is depressed, thereby stretching spring 35. Upon release, corsspiece 33 snaps back to its rest position thereby propelling the ball. The trajectory of the ball can be controlled by varying the position of the adjustable stop 45 and consequently the length of the chain. In this manner, the amount by which the end of crosspiece 33 is raised is controlled. Inside and outside pitches are made possible by rotating the pitching device to the right or left. An alternative embodiment of the pitching mechanism is shown in FIG. 5B. In this embodiment, numeral 43' designates a spring loaded hinge for instance a hinge with a coil. Also in this embodiment, the adjustable stop device 45 is used.

Figure 6A:
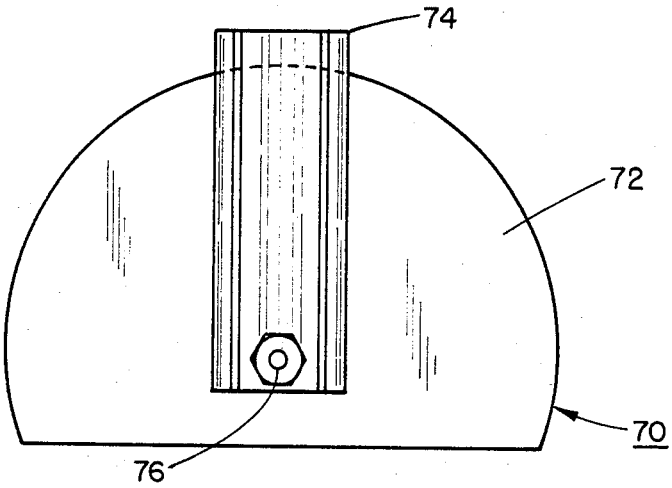
FIGS. 6A, 6B and 6C show a top plan view, a side view and a front view respectively of a throwing mechanism for throwing the ball.
Figure 6B:
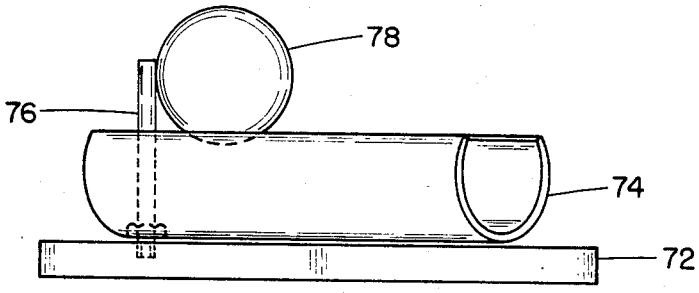
Figure 6C:
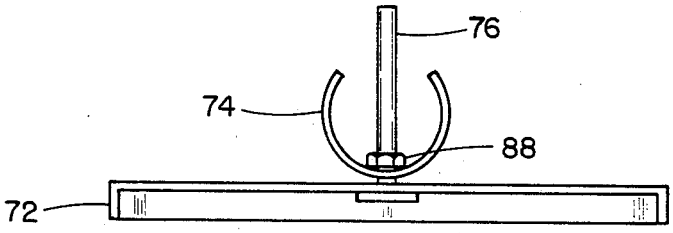
Figure 7A:
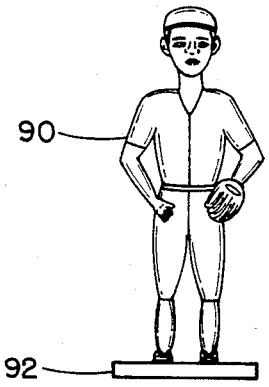
FIG. 7 of the drawings shows two views of a typical figurine used in the game.
Figure 7B:
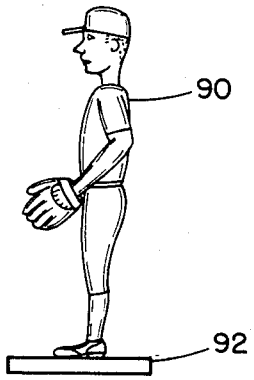

A ball throwing device 70 is shown in FIGS. 6A, 6B and 6C. It consists of a flat semicircular base 72 on which is mounted a trough-shaped guide 74 with a vertical stop 76 fastened to the base 72 at one end of the guide 74 by means of a nut. To use the ball thrower, the player places it on the board 10 at the location of the play, and puts the ball 78 in the guide against the vertical stop 74. The player steadies the base 72 with one hand and propels the ball forward by hitting it with a finger of the other hand. As shown in FIGS. 6B and 6C, the guide 74 is a rod held by the nut 88 and reaching into the base 72.

Five figurines 90,92, representing three base runners and two fielders, are included. Each of the figurines, which can be appropriately shaped and colored, has a flat, weighted base 92 so that it can be placed on the playing board 10 in an erect position.

Miniature baseball, according to the invention is played as follows:

The game is played by one or more players on each side. If there is more than one player on each side, the other players can be used to throw, arrange the infield blocks, set up the outfield discs and advance the runners. The players take turns at batting, never going out of sequence. The three outfield discs 26 are positioned in the outfield to simulate areas covered by left, center and right fielders. They are placed differently for "pull" hitters, weak hitters, long ball or play at the plate. The infield blocks 24 are positioned in the infield between the infield back line barrier 20 and the infield front line 22. The infield blocks are placed in the best defensive position by the players, depending upon the strength and batting technique of the opposing players. The infield blocks 24 should be positioned in the infield at an angle with the infield back line barrier 24 so that balls which hit the infield blocks will remain in the infield. Balls that bounce off or between the infield blocks and go into the outfield are scored as hits. Play is commenced by one of the players selecting one of the bats 58, inserting the pinky of his hand into the flexible finger loop and preparing to hit the pitch. The opposing player places the ball in the pitching mechanism 12 and pitches the ball to the batter. For a called strike, the ball must hit the strike zone plate 14 without a bounce. The strike zone plate is placed directly behind home plate. The players must agree on the placement of the strike zone plate before the start of the game. Usually it is best to have the zone just touching the rear of home plate. The pitching mechanism 12 can be rotated to the right or to the left to achieve an inside or outside pitch. Balls pitched out of the playing area, without a bounce, will be called a wild pitch and the runner will advance one base.

The arm and the body of the pitcher must be removed from the playing area after each pitch to keep from being hit by the ball. If the pitcher or other defensive player is hit with the ball, the batter will be credited with a double.

The batter can hit any pitch thrown, even if it bounces before home plate. If the ball is hit with the batter's fingers or hand instead of the bat, it will be considered a strike. The batter must not move the board when he swings or it will be called a strike. Balls that are hit will be scored according to the rules that follow.

Balls hit to the outfield and hitting the outfield discs without a bounce will simulate an out. Balls reached the outfield areas without a bounce, and not hitting the outfiled discs will be called hits. Balls which hit in front of the discs and hit the disc after the bounce will be scored as a single. Balls which hit the outfield and pass the discs without hitting them will be scored as doubles if they reach the wall; those that don't reach the wall will be scored as singles. Balls hit over the extra base marker and landing between the 375 ft. sign and the 410 ft. sign on the wall will be scored as a triple.

The rules may be expanded so that balls hit over the extra base marker and landing in front of, or striking, different sections of the wall, will be scored differently. Different sections of the wall and/or baseboard can be covered with different materials, such as wood, metal or plastic, thus producing a distinctive sound upon impact with the ball, thereby helping the players determine exactly where the ball hit. FIG. 1 shows a section 50 of the outfield wall 40 covered with metal.

Balls going over the outfield wall 40, without a bounce, will be scored as a home run.

Similar rules govern the scoring of hits and outs for balls reaching the infield. Other rules deal with stealing bases, throws, hit and run, doubling runner, and bunts and sacrifices.

During the playing of the game the figurines are used to represent the runners being advanced around the bases. The figurines representing the fielders are used in throwing situations in conjunction with the throwing device. Throws in a steal situation can be made only from designated throw spots designated by numerals 34 and 36. A throw is successful if the ball hits the figurine representing the fielder who is to receive the thrown ball.

In a variation of the game, strategy cards are included for use by the player at bat. These cards can be used by the batter, with runners on base, to indicate steals, hit and run, sacrifices, etc. A blank card is also provided to indicate that there is no play on. The latter can be used to fool the opposing players. The players can agree to limit the number and/or use of these cards, so as not to slow down the game.

The invention has been described in connection with a preferred embodiment. However many alternatives and variations may be evident to those skilled in the art in view of the foregoing description. Accordingly, it is intended to encompass all such variations and alternatives. It is understood that the particular embodiments and representations shown in the drawings and described above, are given merely for purposes of explanation and illustration without intending to limit the scope of the claims to the specific details disclosed.

What is claimed is:

1. A miniature baseball game, which can be played by two or more players, comprising in combination:

(a) a baseboard having a baseball diamond including home plate, base markers, pitcher's box and foul lines, marked thereon;

(b) a miniature baseball;

(c) a miniature bat adapted to be held in one hand by a player;

(d) a pitching device adapted to pitch said miniature baseball;

(e) two restraining means, one each attached to said baseboard on each side of home plate, said restraining means extending along a direction substantially perpendicular to a line drawn between home plate and the pitching device;

(f) three movable outfield pieces, located in the outfield portion of said baseboard, to be hit by batted miniature baseballs thereby denoting a play in that area, each of said outfield pieces havinq an eyelet on its side;

(g) an extra base marker comprising an adjustable cord passing through each of said outfield piece eyelets, and having each end adjustably fastened to said baseboard along the extremities of the respective foul line markings;

(h) four movable infield pieces, located in the infield portion of said baseboard, and adapted to cause batted miniature baseballs which hit them to bounce off them and stay in the infield area denoting an out;

(i) a movable throwing device adapted to enable a player to propel said miniature baseball; and (j) a plurality of movable figurines representing base runners and fielders.

2. The game as described in claim 1, wherein there are three differently sized miniature bats between $4\frac{1}{2}''$ and $6''$ long and between $\frac{5}{8}''$ and $\frac{3}{4}''$ in diameter.

3. The game as described in claim 1, wherein the pitching device comprises:

(k) a right angle bracket rotatably fastened to said baseboard, whereby it can rotate about an axis perpendicular to said baseboard;

(l) a flat crosspiece attached by a hinge to one end of said right angle bracket, whereby said crosspiece can rotate about an axis parallel to said baseboard;

(m) a spring with one end attached to said crosspiece and the other end attached to said right angle bracket;

(n) a receptacle, adapted to receive said miniature baseball, attached to said crosspiece at a point between said hinge and the end of said crosspiece furthest from home plate;

(o) a ball deflector attached to said crosspiece at a point between said receptacle and the end of said crosspiece closest to home plate; and (p) an adjustable stop located between said right angle bracket and said crosspiece whereby the rise of the crosspiece can be varied.

4. The game as described in claim 1, wherein the restraining means further comprises a strip having a groove, and a flexible, ring-shaped loop slidably attached to said groove and adapted for insertion thereinto of the player's pinky finger, whereby his swing is limited.

5. The game as described in claim 1, wherein said extra base marker comprising said adjustable cord is slidably fastened at each end to slots in said baseboard.

6. The game as described in claim 1, wherein said restraining means further comprises an elongated rod fastened to said baseboard at both ends, and a flexible ring-shaped loop slidably attached to said rod and adapted for insertion thereinto of the player's pinky finger, whereby his swing is limited.

7. The game as described in claim 1, wherein two outfield walls are located along two sides of said baseboard adjacent to the outfield area of said baseball diamond, and wherein predetermined areas of said baseboard and said outfield walls are covered with different materials whereby a distinctive sound is heard when one of said predetermined areas is hit by said miniature baseball, thereby helping players determine which of said predetermined areas has been hit by said miniature baseball.

* * * * *